US005771550A

United States Patent [19]

Laphan et al.

[11] Patent Number: 5,771,550

[45] Date of Patent: Jun. 30, 1998

[54] METHOD OF LINING SHEET METAL CASKET WITH LIQUID IMPERVIOUS LINER AND CASKET WITH LINER CONSTRUCTED BY SUCH METHOD

[75] Inventors: Dennis C. Laphan, Cincinnati; Ilija Rojdev, Fairfield, both of Ohio

[73] Assignee: Batesville Casket Company, Inc., Batesville, Ind.

[21] Appl. No.: 522,199

[22] Filed: Aug. 31, 1995

[51] Int. Cl.[6] ..... A61G 17/00

[52] U.S. Cl. ..... 27/19; 27/2

[58] Field of Search ..... 27/2, 7, 19, 14, 27/17, 35, 6

[56] References Cited

U.S. PATENT DOCUMENTS

| | | | |
|---|---|---|---|
| Re. 33,971 | 6/1992 | Wolfe . | |
| Re. 34,846 | 2/1995 | McGuire . | |
| 58,756 | 2/1866 | Scollay . | |
| D. 341,012 | 11/1993 | Baird . | |
| 675,679 | 6/1901 | Shaw . | |
| 1,261,707 | 4/1918 | Cook . | |
| 2,247,617 | 7/1941 | Metz . | |
| 2,882,584 | 4/1959 | Kidd . | |
| 3,435,494 | 4/1969 | Bernard . | |
| 3,488,818 | 1/1970 | Orr . | |
| 3,964,140 | 6/1976 | Gauchard . | |
| 4,372,014 | 2/1983 | Simpson | 52/105 X |
| 4,448,826 | 5/1984 | Davidian . | |
| 4,780,940 | 11/1988 | Jay . | |
| 4,827,581 | 5/1989 | Davidian . | |
| 4,882,821 | 11/1989 | Sims, Jr. | 27/2 X |
| 4,949,439 | 8/1990 | Semon . | |
| 4,951,367 | 8/1990 | Wolfe . | |
| 5,092,020 | 3/1992 | MaGuire . | |
| 5,093,968 | 3/1992 | Rojdev et al. . | |
| 5,121,529 | 6/1992 | McClure . | |
| 5,140,728 | 8/1992 | Chandler et al. . | |
| 5,201,980 | 4/1993 | Chandler et al. . | |
| 5,222,281 | 6/1993 | Guerin . | |
| 5,245,733 | 9/1993 | Goria . | |
| 5,301,398 | 4/1994 | Bursey, Jr. . | |
| 5,321,873 | 6/1994 | Goria . | |
| 5,619,785 | 4/1997 | Tambussi | 27/6 X |

FOREIGN PATENT DOCUMENTS

| | | |
|---|---|---|
| 1151167 | 1/1958 | France . |
| 2532544 | 3/1984 | France . |
| 2538698 | 7/1984 | France . |
| 2590796 | 12/1985 | France . |
| 2626245 | 7/1989 | France . |
| 2719154 | 11/1978 | Germany . |
| 4225266 | 2/1993 | Germany . |
| 2206334 | 1/1989 | United Kingdom . |

OTHER PUBLICATIONS

Spuhl Gasketing Technology, 7 pages.
Spuhl Anderson Resin Dispensing Systems, 6 pages.

*Primary Examiner*—Kien T. Nguyen
*Attorney, Agent, or Firm*—Wood, Herron & Evans

[57] ABSTRACT

A method of lining a casket with a liquid impervious liner comprises the steps of providing a casket shell having a pair of side walls, a pair of end walls and a bottom wall, providing a plastic liner having a pair of side walls, a pair of end walls and a bottom wall, inserting the liner into the casket, heating the liner to soften the liner, applying a pressure differential across the softened liner relative to the casket shell to urge the side, end and bottom walls of the softened liner into engagement with the side, end and bottom walls of the casket shell, and permitting the liner to cool. A combination casket and liner is constructed by the method.

38 Claims, 2 Drawing Sheets

METHOD OF LINING SHEET METAL CASKET WITH LIQUID IMPERVIOUS LINER AND CASKET WITH LINER CONSTRUCTED BY SUCH METHOD

FIELD OF THE INVENTION

This invention relates generally to burial caskets, and more particularly to a method of lining a burial casket, for example sheet metal, wood and plastic burial caskets, with a liquid impervious lining and to a casket with such a liner.

BACKGROUND OF THE INVENTION

Liquids of decomposition from the body of a deceased can be extremely corrosive. Likewise, embalming fluids and odor counteractants can create corrosive conditions, either alkaline or acidic. These liquids can attack the metal surfaces of sheet metal caskets resulting in premature failure of the casket.

Caskets are warranted by the manufacturer against corrosive failure and consequent leakage for a specified period of time. Steps must be taken to ensure that the metal caskets can survive for the time period warranted.

Premature metal casket failure due to corrosion is also undesirable in the setting of above ground interment or burial, or otherwise in mausoleums. Leakage created by such casket failure is undesirable from the standpoint of friends and family members of the deceased which may continue to pay respects to the deceased by visiting the mausoleum, and from the standpoint of the environment.

Efforts at preventing premature casket failure by way of corrosion have taken two general forms. In one form, a plastic tray is placed in the bottom of the casket shell on the shell bottom wall and below the body support structure. The tray is sized in height so as to create a sufficient volume for containing the liquids of decomposition generated by the body. These casket trays may be employed in wood caskets as well as metal caskets. Examples of such trays are disclosed in U.S. Pat. Nos. 4,949,439, Re. 33,971 and Re. 34,846, the latter of which is assigned to the assignee of the present invention.

The disadvantage of these types of devices is that the tray either is not designed to and in fact does not seal to the casket shell walls as is the case in U.S. Pat. No. Re. 34,846, or if the tray is designed to seal to the casket walls, the seal is less than perfect. Thus, liquids can spill over the tray side and end walls and find their way down to the exposed bottom wall of the casket shell resulting in consequent corrosion of the casket shell bottom wall. Also in the case of nonprotective steel caskets, the liquid will finds its way out of the casket and in the mausoleum onto the marble surfaces therein damaging same. In addition, the greenhouse effect in mausoleums generates condensate inside the casket on the shell side and end walls, which condensate can run down the walls and find its way down to the bottom of the casket in the absence of a perfect seal between the tray and the casket shell walls.

In another form, a thin coating of liquid impervious material, for example plastisol, is applied to the interior of the sheet metal casket as by spraying, brushing, dipping, rolling or the like. Examples of such are disclosed in U.S. Pat. Nos. 4,827,581 and 4,448,826.

The disadvantage of these techniques is that the method of applying the coating to the casket shell interior is less than exact. In spraying, brushing and rolling one is never sure if all surfaces, welds, metal imperfections and the like have been adequately and completely covered as visual verification is next to impossible. The odds are that such application techniques may result in missed areas which are therefore left unprotected. The only way to verify one hundred percent coverage is with the use of x-ray which is an expensive and costly process. Dipping the casket shell in or filling the casket shell with the coating material and then removing the casket from the dip tank or removing the excess coating from within the casket shell generally results in better coverage than spraying, brushing and rolling but is costly to implement and results in coating material wastage.

It is therefore an objective of the present invention to provide an improved method of lining a sheet metal casket with a liquid impervious liner which is cost effective, relatively easy and simple to implement and which results in one hundred percent coverage of the interior of the casket shell.

SUMMARY OF THE INVENTION

The present invention attains the stated objectives by providing a method of lining a sheet metal casket with a liquid impervious liner. The method comprises the steps of providing a casket shell having a pair of side walls, a pair of end walls and a bottom wall, providing a plastic liner having a pair of side walls, a pair of end walls and a bottom wall, inserting the liner into the casket, heating the liner to soften the liner, applying a pressure differential across the softened liner relative to the casket shell to urge the side, end and bottom walls of the softened liner into engagement with the side, end and bottom walls of the casket shell, and permitting the liner to cool.

The step of applying a pressure differential across the softened liner relative to the casket shell comprises either applying a negative pressure between the liner and the casket shell, applying a positive pressure within the liner interior relative to the casket shell, or applying both a negative pressure between the liner and the casket shell and a positive pressure within the liner interior relative to the casket shell.

In another form the method comprises the steps of providing a casket shell having a pair of side walls, a pair of end walls and a bottom wall, providing a plastic liner having a pair of side walls, a pair of end walls and a bottom wall, inserting the liner into the casket, sealing the liner side and end walls to the casket shell side and end walls, heating the liner to soften the liner, applying a pressure differential across the softened liner relative to the casket shell to urge the side, end and bottom walls of the softened liner into engagement with the side, end and bottom walls of the casket shell, and permitting the liner to cool.

In this form of the invention the step of applying a pressure differential across the softened liner relative to the casket shell comprises either applying a negative pressure between the liner and the casket shell or applying both a negative pressure between the liner and the casket shell and a positive pressure within the liner interior relative to the casket shell.

The present invention also provides a combination casket and liner constructed by the method.

In another aspect of the present invention, a combination casket and liner is provided which comprises a casket shell having a pair of side walls, a pair of end walls and a bottom wall, a plastic liner having a pair of side walls, a pair of end walls and a bottom wall inserted into the shell, the liner side, end and bottom walls urged into engagement with the shell side, end and bottom walls, the liner side and end walls extending upwardly substantially to the top edge of the shell side and end walls, and a gasket disposed between the top edges of the liner and the shell around the perimeter of the casket.

The shell has an inwardly directed flange having first and second upwardly directed surfaces, with the second surface disposed inward of and below the first surface. The liner has an outwardly directed flange having top and bottom surfaces, with the bottom surface disposed atop the shell flange second surface.

The gasket has a circular cross-section. The shell flange first surface and liner flange top surface have confronting, cooperating quarter-circular grooves around their respective perimeters forming a semi-circular groove into which is received the circular cross-section gasket.

In yet another aspect of the present invention, a combination sheet metal casket and liquid impervious liner comprises a casket shell having a pair of side walls, a pair of end walls and a bottom wall, a lid pivoted to the shell and closable thereon, a plastic liner having a pair of side walls, a pair of end walls and a bottom wall inserted into the shell, the liner side, end and bottom walls urged into engagement with the shell side, end and bottom walls, the liner side and end walls extending upwardly substantially to the top edge of the shell side and end walls, a first gasket disposed between the top edges of the liner and the shell around the perimeter of the casket, and a second gasket disposed between the shell and the lid.

As in the prior embodiments, the shell has an inwardly directed flange having first and second upwardly directed surfaces, the second surface disposed inward of and below the first surface, and additionally has an inwardly directed surface intermediate the first and second upwardly directed surfaces. Similarly as in the prior embodiments, the liner has an outwardly directed flange having top and bottom surfaces and additionally has an outwardly directed surface, the bottom surface disposed atop the shell flange second surface. The lid has an inwardly directed flange having a downwardly directed surface. The first gasket seals between the shell flange inwardly directed surface and the liner flange outwardly directed surface, and the second gasket seals between the shell first upwardly directed surface and the lid downwardly directed surface.

The first gasket also seals between a portion of the lid and the shell flange and liner flange. The portion of the lid to which the first gasket seals may be either the downwardly directed surface of the inwardly directed flange or a downwardly directed surface of an outwardly directed flange of a plastic dish inserted into the lid to receive decorative puffing and cap panel components.

As in the prior embodiments, the first gasket has a circular cross-section, and the shell flange first surface and liner flange top surface have confronting, cooperating quarter-circular grooves around their respective perimeters forming a semi-circular groove into which is received the circular cross-section first gasket.

The second gasket comprises a flat base and an elongated ridge projecting above the base. The ridge is generally triangular in cross-section and has an outwardly facing surface that is concave to urge the ridge outwardly when the pressure of the lid is applied against the rib. The second gasket further comprises a first integral small rib extending along the top of the ridge for sealing engagement with the lid flange, and a second integral small rib on the undersurface of the base, the second rib contacting the shell flange.

The major advantage of the present invention is that an improved method of lining a sheet metal casket with a liquid impervious liner is provided which is cost effective, relatively easy and simple to implement and which results in one hundred percent coverage of the interior of the casket shell.

These and other objects and advantages of the present invention will become more readily apparent during the following detailed description taken in conjunction with the drawings herein, in which:

DETAILED DESCRIPTION OF THE INVENTION

Figure 1:
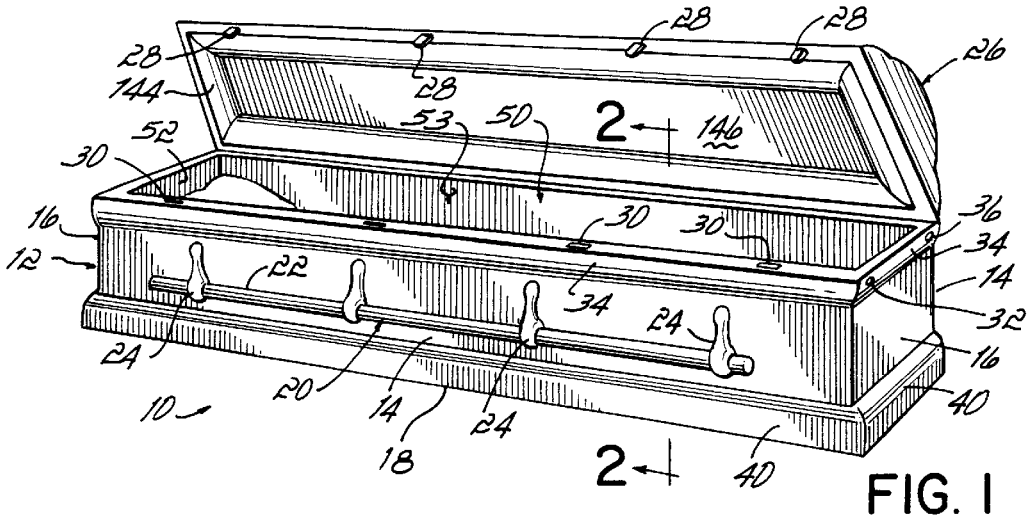
FIG. 1 is a perspective view of a casket with liquid impervious liner therein constructed by the method of the present invention.

Referring first to FIG. 1, there is illustrated a casket 10 constructed according to the principles of the present invention. Casket 10 is generally of sheet metal construction and includes a shell 12 having a pair of side walls 14, a pair of end walls 16 and a bottom wall 18. Casket handling structure 20 in the form of an elongated handlebar 22 is attached to the side walls 14 via arms 24. A lid 26 is hingedly secured to the top edge of one of the side walls 14 by hinges or other means known to those skilled in the art. Lid 26 and shell 12 include cooperating latching structure 28 and 30, respectively, for locking the lid 26 in a closed position on the shell 12. An access aperture 32 in end wall 12 provides access to locking mechanism (not shown) located within rim 34 of side wall 14 for locking lid 26 onto shell 12. Another aperture 36 in end wall 12 provides a means for inserting a memorial record tube or the like containing inditia of the remains within the casket 10.

Figure 2:
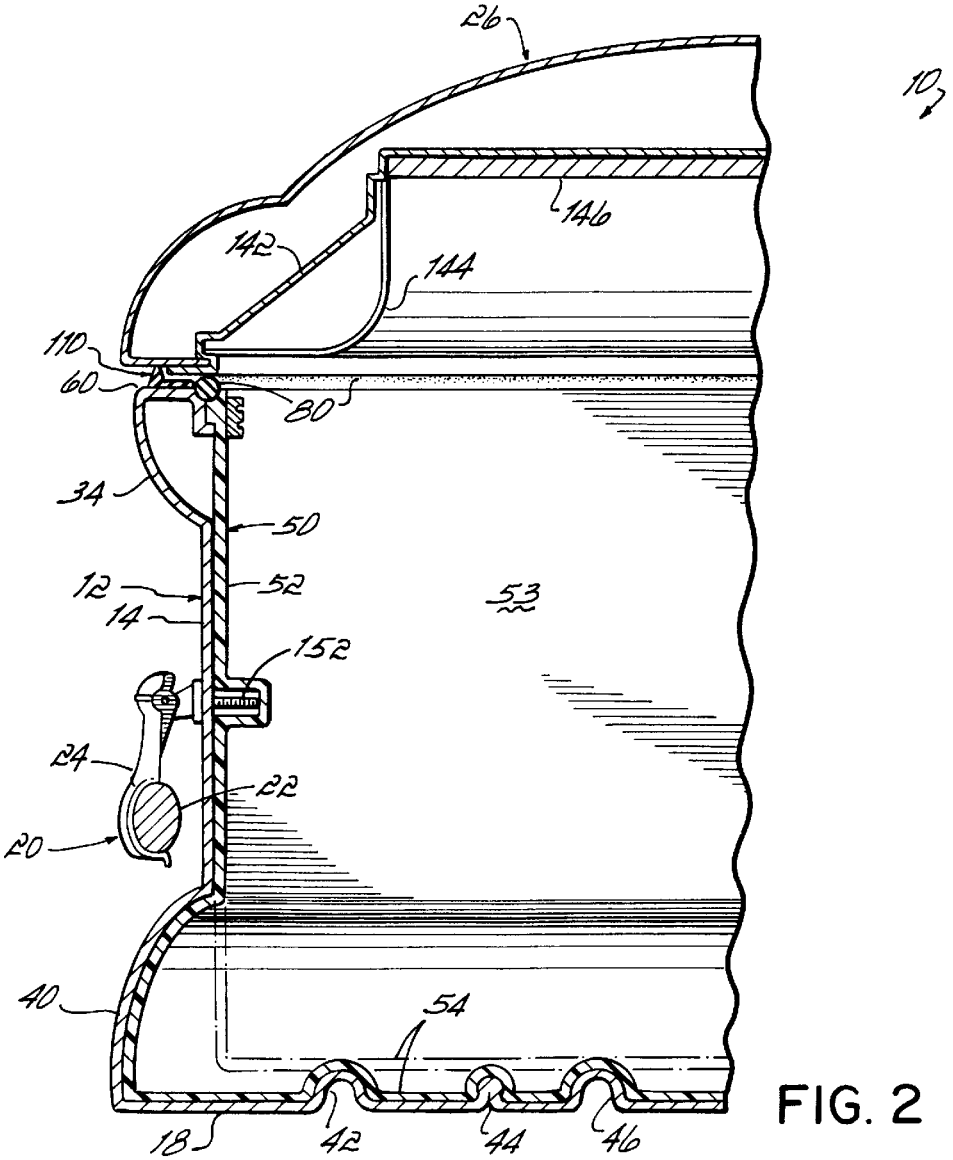
FIG. 2 is a view taken along line 2—2 of FIG. 1.

Referring now to FIG. 2, the casket 10 is seen in partial cross-section. As is seen in the Figure, each side wall 12 includes an undercut region 40 in a lowermost location where the side wall 14 joins the bottom wall 18. The end wall 16 has similar undercut features therein, but the same are not shown in FIG. 2. Bottom wall 18 includes a number of ribs or convolutions 42, 44 and 46 to stiffen the bottom wall 18 to reduce deflection thereof during loading of the bottom wall 18. Undercut feature 40 provides similar stiffness to the side walls 14 (and end walls 16) as well as providing aesthetic or decorative benefits.

A preformed, for example, blow molded, plastic liner tub 50 extends generally from the top edges of the side and end walls 14 and 16 to the bottom 18 of the shell 12. Tub 50 includes a pair of side walls 52, one of which is shown in FIG. 2, a pair of end walls (not shown in FIG. 2) and a bottom wall 54. The portion of the tub 50 above the undercut 40 of shell side wall 14 as well as the portion below undercut 40 shown in phantom illustrates the shape of the tub 50 in its preformed state upon placement into shell 12. After the application of a vacuum molding process to the tub 50, which will be subsequently described, the tub 50 assumes the hatched configuration, conforming closely to the undercut 40 in the side walls 14 (and end walls 16) and convolutions 42, 44 and 46 on bottom wall 18.

Figure 3:
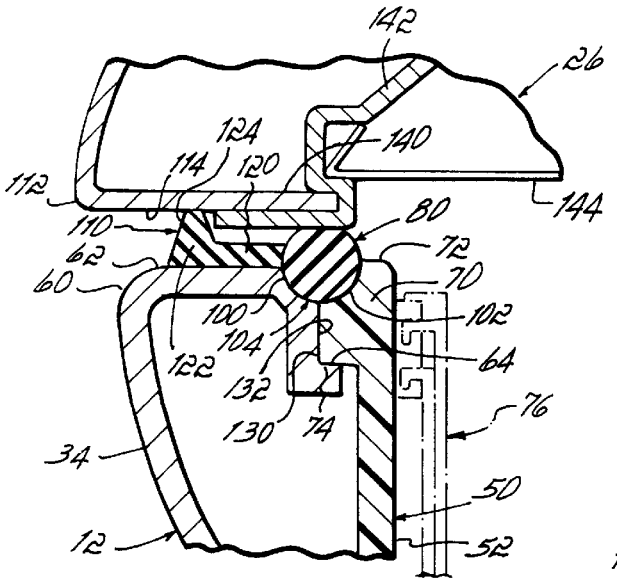
FIG. 3 is a cross-sectional view, enlarged, of a composite sealing arrangement between liner, shell and lid.

Referring now to FIG. 3, the interface of the shell 12 and lid 26 is shown enlarged. Shell 12 includes an inwardly directed flange 60 having a first upwardly directed surface 62 and a second upwardly directed surface 64 disposed inward of and below the first surface 62. The liner 50 has an outwardly directed flange 70 having top and bottom surfaces 72 and 74 respectively. The bottom surface 74 is disposed atop the shell flange second surface 64. Also shown in FIG. 3, in phantom, is a device 76 for readily attaching and detaching decorative material, for example, big body, small body or the like, to the liner 50. The device 76 is generally of the construction as described in copending application Ser. No. 08/406,510 filed Mar. 20, 1995, assigned to the assignee of the present invention and hereby incorporated by reference herein as if fully set forth in its entirety. It is contemplated that the portion of the device described in Ser. No. 08/406,510 as being secured to the casket wall be integrally molded with the liner tub 50.

Figure 4:
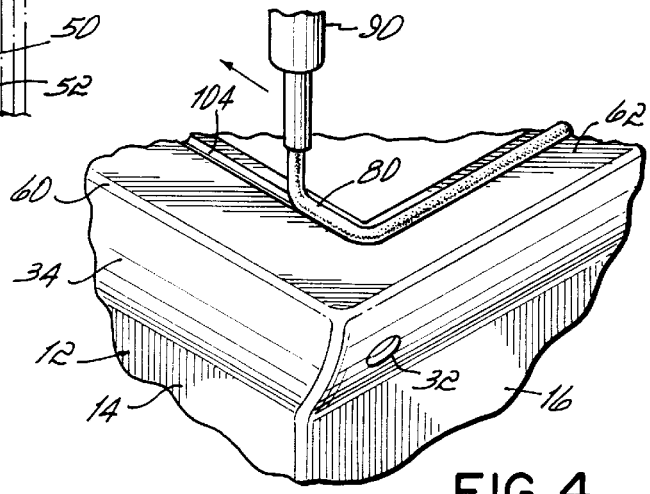
FIG. 4 is a fragmentary perspective view illustrating placement of the seal between the casket shell and liner.

A circular cross-section gasket 80 is disposed between the liner 50 and shell 12 around the perimeter of the casket 10. As shown in FIG. 4, the gasket 80 is "extruded in place" i.e. extruded onto the shell 12 and liner 50 after placement of the liner within the shell via a traveling extruder 90. Such a traveling extruder 90 is fabricated by Spühl Anderson Machine Company, 1610 Parallel Street, Chaska, Minn. 55318. The material from which gasket 80 is fabricated is preferably polyurethane foam shore A 20 compression.

The shell flange first surface 62 and liner flange top surface 72 have confronting, cooperating quarter-circular grooves 100 and 102, respectively, around their respective perimeters forming a semi-circular groove 104 into which is received the circular cross-section gasket 80.

A second gasket 110 is disposed between the shell 12 and lid 26. Gasket 110 may also be extruded, and either separately or preferably simultaneously with the gasket 80. The lid 26 has an inwardly directed flange 112 having a downwardly directed surface 114. The second gasket 110 seals between the shell first upwardly directed surface 62 and the lid downwardly directed surface 114. Gasket 110 is of the type disclosed in U.S. Pat. No. 5,093,968 assigned to the assignee of the present invention, the entire substance of which is hereby incorporated by reference herein as if fully set forth in its entirety. The gasket 110 comprises, generally, a flat base 120 and an elongated ridge 122 projecting above the base 120. The ridge 122 is generally triangular in cross-section and has an outwardly facing surface 124 which is concave to urge the ridge 122 outwardly when the pressure of the lid 26 is applied against the ridge 122. The elongated ridge 122 may further include a first integral small rib (not shown in drawings, but shown in U.S. Pat. No. 5,093,968) extending along the top of the ridge 122 for sealing engagement with the lid flange 112, and a second integral small rib (not shown in drawings, but shown in U.S. Pat. No. 5,093,968) on the undersurface of the base 120, this second rib contacting the shell flange 62.

Gasket 80 thus seals between outwardly directed surface 130 of flange 70 of tub 50, and inwardly directed surface 132 of flange 62 of shell 12. In addition, seal 80 seals between a portion of the lid 26 and the shell flange 62 and liner flange 72. Gasket 80 may either seal against the downwardly directed surface 114 of the inwardly directed flange 112 of the lid 26, or alternatively may seal against an outwardly directed flange 140 of a plastic snap-in dish assembly 142 which snaps into lid 26 and which is adapted to receive a decorative dish assembly comprising puffing 144 and cap panel 146 (FIG. 2). Such a plastic snap-in dish is disclosed in co-pending application Ser. No. 08/369,350, filed Jan. 6, 1995 and assigned to the assignee of the present invention, the entire substance of which is hereby incorporated by reference herein as if fully set forth in its entirety.

Thus, not only does gasket 80 provide a seal between tub 50 and shell 12 for the vacuum forming of tub 50 in shell 12, which will be subsequently described, but in addition, seal 80 provides an additional double seal or composite seal between the shell 12 and lid 26 when combined with the gasket 110.

Figure 5:
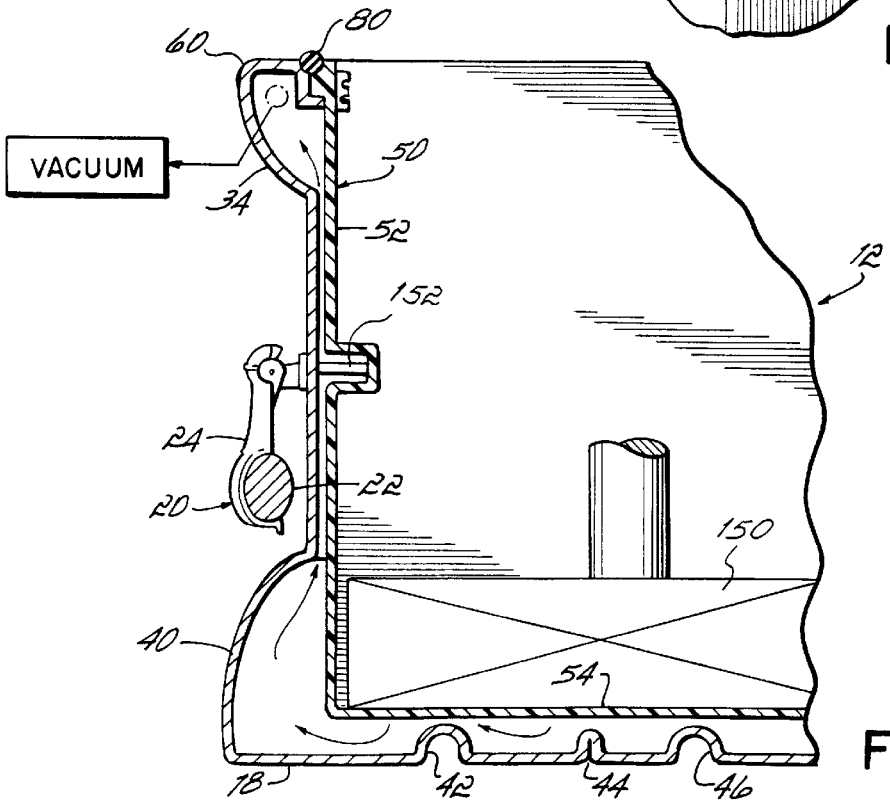
FIG. 5 is a view similar to FIG. 2 illustrating the step of vacuum molding the liner to the casket shell.

Referring now to FIG. 5, the vacuum forming of the tub 50 to the shell 12 is illustrated. As is seen in the Figure, the tub 50 has been inserted into the shell 12, and the gasket 80 has been extruded in place around the perimeter of the casket thus sealing the tub 50 to the shell 12. Next a heater 150 is dropped down into the tub 50 approximately three-quarters quarters to the bottom, wherein heat generated by quartz light strips or the like generates a temperature of approximately 290° F. to 300° F. to soften the tub 50. The heat source is then removed. A vacuum source may be attached to either of the apertures 32 or 36, as shown in FIG. 1 and a vacuum of approximately 20 to 21 psig is applied. The combination of the heat and vacuum causes the softened tub 50 to be vacuum molded to the shell 12 into the configuration shown in FIG. 2. The tub seals over the hardware shown at 152 thus sealing any holes in the casket shell walls required to install the hardware. Vacuum is applied until the tub temperature drops to about 180° F. during ambient cooling, at which time the vacuum is removed and the tub 50 returns to room temperature. Methods other than the illustrated applied vacuum can be employed to urge the softened tub into engagement with the shell. All that is required is that a pressure differential be applied across the softened liner relative to the casket shell to urge the softened liner into engagement with the shell. For example, while the illustrated vacuum applies a negative pressure between the liner and the shell, a positive pressure could be applied within the liner interior relative to the casket shell or a combination of negative and positive pressure could be utilized. Further, heated air could be blown into the liner to soften the tub and create a positive pressure therein to urge the softened liner into conformity with the casket shell.

The tub 50, which is preferably fabricated of polyethylene, preferably has a wall thickness of approximately 0.080 in. Other materials such as polypropelene or ABS may be used to form the tub. To add additional stiffness and strength to the composite liner and shell, adhesive may be added between the tub and the shell to produce a true composite structure. In this case, the gauge thickness of the sheet metal from which the shell 12 is fabricated may be dropped from 16 gauge down to 18 gauge or even 20 gauge.

What is claimed is:

1. A combination casket and liquid impervious liner comprising:

a casket shell having a pair of side walls, a pair of end walls and a bottom wall, one side wall of said pair of shell sidewalls including an undercut therein;

said one shell side wall including an aperture and hardware mounted to said one shell side wall including a portion extending through said aperture;

a plastic liner having a pair of side walls, a pair of end walls and a bottom wall and being inserted into said shell, one side wall of said pair of plastic liner side walls including an undercut therein conforming to said undercut in said one shell side wall, said one plastic liner side wall additionally conforming to said portion of said hardware extending through said aperture.

2. The combination of claim 1 wherein said liner side and end walls extend upwardly substantially to the top edge of said shell side and end walls.

3. A combination casket and liquid impervious liner comprising:

a casket shell having a pair of side walls, a pair of end walls and a bottom wall, one side wall of said pair of shell sidewalls including an undercut therein;

a plastic liner having a pair of side walls, a pair of end walls and a bottom wall and being inserted into said shell, one side wall of said pair of plastic liner side walls including an undercut therein conforming to said undercut in said one shell side wall;

wherein said liner side and end walls extend upwardly substantially to the top edge of said shell side and end wall; and further including a gasket disposed between the top edges of said liner and said shell around the perimeter of said casket.

4. A combination casket and liquid impervious liner comprising:

a casket shell having a pair of side walls, a pair of end walls and a bottom wall;

a plastic liner having a pair of side walls, a pair of end walls and a bottom wall inserted into said shell;

said liner side, end and bottom walls urged into engagement with said shell side, end and bottom walls by heating said liner to soften said liner and applying a pressure differential across said softened liner relative to said shell;

wherein said liner side and end walls extend upwardly substantially to the top edge of said shell side and end walls;

a gasket disposed between the top edges of said liner and said shell around the perimeter of said casket;

wherein:

said shell has an inwardly directed flange having first and second upwardly directed surfaces, said second surface disposed inward of and below said first surface; and said liner has an outwardly directed flange having top and bottom surfaces, said bottom surface disposed atop said shell flange second surface.

5. The combination of claim 4 wherein said gasket has a circular cross-section.

6. The combination of claim 5 wherein:

said shell flange first surface and said liner flange top surface have confronting, cooperating quarter-circular grooves around their respective perimeters forming a semi-circular groove into which is receive said circular cross-section gasket.

7. A combination casket and liquid impervious liner comprising:

a casket shell having a pair of side walls, a pair of end walls and a bottom wall;

a plastic liner having a pair of side walls, a pair of end walls and a bottom wall and being inserted into said shell;

said liner side, end and bottom walls urged into engagement with said shell side, end and bottom walls;

said liner side and end walls extending upwardly substantially to the top edge of said shell side and end walls; and a gasket disposed between the top edges of said liner and said shell in sealing engagement therewith and disposed around the perimeter of said casket.

8. A combination casket and liquid impervious liner comprising:

a casket shell having a pair of side walls, a pair of end walls and a bottom wall;

a plastic liner having a pair of side walls, a pair of end walls and a bottom wall inserted into said shell;

said liner side, end and bottom walls urged into engagement with said shell side, end and bottom walls;

said liner side and end walls extending upwardly substantially to the top edge of said shell side and end walls; and a gasket disposed between the top edges of said liner and said shell around the perimeter of said casket;

wherein:

said shell has an inwardly directed flange having first and second upwardly directed surfaces, said second surface disposed inward of and below said first surface; and said liner has an outwardly directed flange having top and bottom surfaces, said bottom surface disposed atop said shell flange second surface.

9. The combination of claim 8 wherein said gasket has a circular cross-section.

10. The combination of claim 9 wherein:

said shell flange first surface and said liner flange top surface have confronting, cooperating quarter-circular grooves around their respective perimeters forming a semi-circular groove into which is received said circular cross-section gasket.

11. A combination casket and liquid impervious liner comprising:

a casket shell having a pair of side walls, a pair of end walls and a bottom wall;

a lid pivoted to said shell and closable thereon;

a plastic liner having a pair of side walls, a pair of end walls and a bottom wall inserted into said shell;

said liner side, end and bottom walls urged into engagement with said shell side, end and bottom walls;

said liner side and end walls extending upwardly substantially to the top edge of said shell side and end walls;

a first gasket disposed between the top edges of said liner and said shell in sealing engagement therewith and disposed around the perimeter of said casket; and a second gasket disposed between said shell and said lid.

12. The combination of claim 11 wherein said first gasket is extruded in place.

13. The combination of claim 11 wherein said first and second gaskets are integrally extruded in place.

14. A combination casket and liquid impervious liner comprising:

a casket shell having a pair of side walls, a pair of end walls and a bottom wall;

a lid pivoted to said shell and closable thereon;

a plastic liner having a pair of side walls, a pair of end walls and a bottom wall inserted into said shell;

said liner side, end and bottom walls urged into engagement with said shell side, end and bottom walls;

said liner side and end walls extending upwardly substantially to the top edge of said shell side and end walls;

a first gasket disposed between the top edges of said liner and said shell around the perimeter of said casket; and a second gasket disposed between said shell and said lid;

wherein:

said shell has an inwardly directed flange having first and second upwardly directed surfaces, said second surface disposed inward of and below said first surface, and an inwardly directed surface intermediate said first and second upwardly directed surfaces;

said liner has an outwardly directed flange having top and bottom surfaces and an outwardly directed surface, said bottom surface disposed atop said shell flange second surface;

said lid has an inwardly directed flange having a downwardly directed surface;

said first gasket sealing between said shell flange inwardly directed surface and said liner flange outwardly directed surface; and said second gasket sealing between said shell first upwardly directed surface and said lid downwardly directed surface.

15. The combination of claim 14 wherein said first gasket also seals between a portion of said lid and said shell flange and liner flange.

16. The combination of claim 15 wherein said portion of said lid is said downwardly directed surface of said inwardly directed flange.

17. The combination of claim 15 wherein said portion of said lid is a downwardly directed surface of an outwardly directed flange of a plastic dish.

18. The combination of claim 15 wherein said first gasket has a circular cross-section.

19. The combination of claim 18 wherein:

said shell flange first surface and said liner flange top surface have confronting, cooperating quarter-circular grooves around their respective perimeters forming a semi-circular groove into which is received said circular cross-section first gasket.

20. The combination of claim 18 wherein said second gasket further comprises:

a first integral small rib extending along the top of said ridge for sealing engagement with said lid flange; and a second integral small rib on the undersurface of said base, said second rib contacting said shell flange.

21. The combination of claim 15 wherein said second gasket comprises:

a flat base; and an elongated ridge projecting above said base;

said ridge being generally triangular in cross-section and having an outwardly facing surface that is concave to urge said ridge outwardly when the pressure of said lid is applied against said rib.

22. A combination casket and liquid impervious liner comprising:

a casket shell having a pair of side walls, a pair of end walls and a bottom wall;

a lid pivoted to said shell and closable thereon;

a plastic liner having a pair of side walls, a pair of end walls and a bottom wall inserted into said shell;

said liner side, end and bottom walls urged into engagement with said shell side, end and bottom walls;

said liner side and end walls extending upwardly substantially to the top edge of said shell side and end walls;

a first gasket disposed between the top edge of said liner and said shell around the perimeter of said casket; and a second gasket disposed between said shell and said lid;

wherein said plastic liner includes attachment structure integrally molded therewith for readily attaching decorative fabric thereto.

23. A combination casket and liquid impervious liner comprising:

a casket shell having a pair of side walls, a pair of end walls and a bottom wall;

a plastic liner having a pair of side walls, a pair of end walls, and a bottom wall, said plastic liner being received in said casket shell; and an attachment structure integrally molded with said plastic liner for readily attaching decorative fabric thereto.

24. A casket comprising:

a casket shell having spaced-apart first and second side walls, spaced-apart first and second end walls, and a bottom wall;

a plastic liner having spaced-apart first and second side walls, spaced-apart first and second end walls, and a bottom wall, said plastic liner being received in said casket shell; and a gasket sealing engaging each of said plastic liner and said casket shell to provide an air impermeable barrier therebetween.

25. The casket of claim 24, wherein said first side wall of said casket shell is formed to include an undercut region and said first side wall of said plastic liner is formed to include an undercut region conforming to said undercut region of said first side wall of said casket shell.

26. The casket shell of claim 25, wherein said second side wall of said casket shell is formed to include an undercut region and said second side wall of said plastic liner is formed to include an undercut region conforming to said undercut region of said second side wall of said casket shell.

27. The casket shell of claim 24, wherein said bottom wall of said casket shell is formed to include at least one rib and said bottom of said plastic liner is formed to include at least one rib conforming to said at least one rib of said bottom wall of said casket shell.

28. The casket of claim 24, further comprising a lid secured to said casket shell and movable to a closed position, said lid including a downwardly directed surface sealingly engaging said gasket when said lid is in the closed position.

29. The casket of claim 28, further comprising a second gasket disposed between said shell and said downwardly directed surface of said lid, said first gasket cooperating with said second gasket to provide a double seal between said shell and said lid.

30. The casket of claim 24, wherein said casket shell cooperates with said plastic liner to define a chamber therebetween.

31. The casket of claim 30, wherein said casket shell is formed to include an aperture in fluid communication with said chamber.

32. The casket of claim 24, further comprising an attachment structure integrally molded with said plastic liner for readily attaching decorative fabric thereto.

33. A casket comprising:

a casket shell having a pair of side walls, a pair of end walls, a bottom wall, and an inwardly directed flange having first and second upwardly directed surfaces, said second surface disposed inward of and below said first surface; and a plastic liner received in said casket shell, said plastic liner having a pair of side walls, a pair of end walls, a bottom wall, and an outwardly directed flange having top and bottom surfaces, said bottom surface disposed atop said shell flange second surface.

34. The casket of claim 33, further comprising a gasket engaging said first upwardly directed surface of said casket shell and said top surface of said flange of said plastic liner around the perimeter of said casket.

35. The casket of claim 34, wherein said gasket has a circular cross-section, said first surface of said flange of said casket shell has a quarter-circular groove extending around the perimeter thereof, wherein said top surface of said flange of said plastic liner has a quarter-circular groove extending around the perimeter thereof, and wherein said groove of said casket shell cooperates with said groove of said plastic liner to define a semi-circular groove receiving said gasket.

36. The casket of claim 34, further comprising a lid secured to said casket shell and movable to a closed position, said lid including a downwardly directed surface sealingly engaging said gasket when said lid is in said closed position.

37. The casket of claim 36, further comprising a second gasket disposed between said casket shell and said lid.

38. A casket comprising:

a casket shell having spaced-apart first and second side walls, spaced-apart first and second end walls, and a bottom wall, said first side wall including an edge defining an aperture;

hardware mounted to said first side wall of said casket shell, said hardware extending inwardly through said aperture; and a plastic liner having spaced-apart first and second side walls, spaced-apart first and second end walls, and a bottom wall, said plastic liner conforming to the shape of said casket shell and sealing between said hardware and said edge of said first side wall of said casket shell.

* * * * *

UNITED STATES PATENT AND TRADEMARK OFFICE

CERTIFICATE OF CORRECTION

PATENT NO. : 5,771,550
DATED : June 30, 1998
INVENTOR(S) : Dennis C. Laphan and Ilija Rojdev It is certified that error appears in the above-indentified patent and that said Letters Patent is hereby corrected as shown below:

Column 1, line 51, "will finds its" should read -- will find its --.

Column 4, line 38, "containing inditia" should read -- containing indicia --.

Column 7, line 47, "into which is receive" should read -- into which is received --.

Column 9, line 55, "the top edge" should read -- the top edges --.

Signed and Sealed this
Third Day of November, 1998

*Attest:*

*Attesting Officer*

BRUCE LEHMAN

*Commissioner of Patents and Trademarks*